US005269703A

United States Patent [19]

Ikegami

[11] Patent Number: 5,269,703

[45] Date of Patent: Dec. 14, 1993

[54] SHIELDED ELECTRICAL CONNECTOR

[75] Inventor: Kenji Ikegami, Hachioji, Japan

[73] Assignee: The Whitaker Corporation, Wilmington, Del.

[21] Appl. No.: 37,652

[22] Filed: Mar. 18, 1993

[30] Foreign Application Priority Data

Apr. 7, 1992 [JP] Japan ..... 4-113144

[51] Int. Cl.[5] ..... H01R 13/00

[52] U.S. Cl. ..... 439/607

[58] Field of Search ..... 439/497, 607-610, 439/660

[56] References Cited

U.S. PATENT DOCUMENTS 4,655,515 4/1987 Hamsher, Jr. et al. ..... 439/497
4,767,345 8/1988 Gutter et al. ..... 439/497
5,184,965 2/1992 Myschik et al. ..... 439/607
5,190,464 3/1993 Chow et al. ..... 439/607

*Primary Examiner*—Joseph H. McGlynn
*Attorney, Agent, or Firm*—Timothy J. Aberle

[57] ABSTRACT

The shielded electrical connector (10) comprises a die-cast shell (20) and metal isolation walls (30) for dividing the cavity in the shell (20). There are signal and ground contacts (77,78) disposed in a row at both sides of the isolation walls (30). The ground contact (78) is directly connected to the isolation wall (30) and the signal contacts (77) establish a micro stripline configuration in combination with the isolation wall (30) for enabling high frequency signal transmission. A plurality of connector modules (75) terminated to one end of the cable (70) are disposed on both sides of the isolation walls (30). The electrically conductive shell (20) is a two-piece structure sandwiching the cable (70) therebetween to provide a strain relief thereof.

9 Claims, 4 Drawing Sheets

SHIELDED ELECTRICAL CONNECTOR

The present invention relates to an electrical connector, more specifically to a shielded electrical connector having an electrically conductive shell for shielding purposes.

BACKGROUND OF THE INVENTION

A shielded electrical connector is essential to the prevention the transmission of electrical noise from or to electronic machines to be used close to one another, especially in signal transmission or interface of digital equipment. Since regulations involving electromagnetic interference (EMI) are increasingly more strict, needs for such shielded electrical connectors are growing rapidly.

A shielded electrical connector is normally used with a flat or circular shielded cable and the shield or ground wires of such cable are electrically connected to a shielded electrically conductive shell essentially covering or enclosing the outside of such shielded electrical connector. The electrically conductive shell is usually connected to an electrically conductive panel or ground conductor layer on a circuit board of the electronic equipment using such a connector.

A typical conductive shell of a conventional shielded electrical connector is disclosed in, for example, Japanese UM Pub. No. 39901/'91 and is configured by stamping and forming an electrically conductive metal plate in such a manner as to cover the mating portion of an insulating housing, and also to be connected to a ground conductor of a circuit board. Also, Japanese Patent Pub. No. 17736/71 discloses a shielded electrical connector in which an electrically conductive layer is formed on the outer surface of an insulating housing to isolate and retain a large number of contacts.

However, the known shielded electrical connector which uses a metal plate does not cover the whole outer surface of the connector, thereby making it difficult to obtain perfect shielding, and it is further very complicated and expensive to assemble the shielding member and the insulating housing. On the other hand, the connector adopting the latter shielding approach has a disadvantage in applications involving a high frequency shielded electrical connectors. Also, conventional shielded electrical connectors experience difficulty in directly connecting ground terminals to the electrically conductive shell.

SUMMARY OF THE INVENTION

In order to solve the aforementioned problems of the conventional shielded electrical connector, the shielded electrical connector according to the present invention uses a metal die-cast material as the electrically conductive shell. The cavity inside of the die-cast shell is divided by an isolation wall made of an electrically conductive metal plate. Discrete connector modules are received and retained in divided cavities for shielding between the rows of contacts of the connector modules as well as for establishing a micro-stripline structure suited for high frequency signal transmission.

Additionally, the shielded electrical connector according to the present invention has a cavity of an electrically conductive shell divided by an isolation wall of an electrically conductive metal plate along which signal and ground contacts are disposed. The ground contacts are directly contacted to the isolation wall through openings in the insulating housing at the side of the isolation wall, thereby allowing optimum grounding of the ground contacts. In a preferred embodiment, both signal and ground contacts are identical to each other and only the orientation of such contacts is changed.

DESCRIPTION OF THE PREFERRED EMBODIMENT(S)

Figure 1:
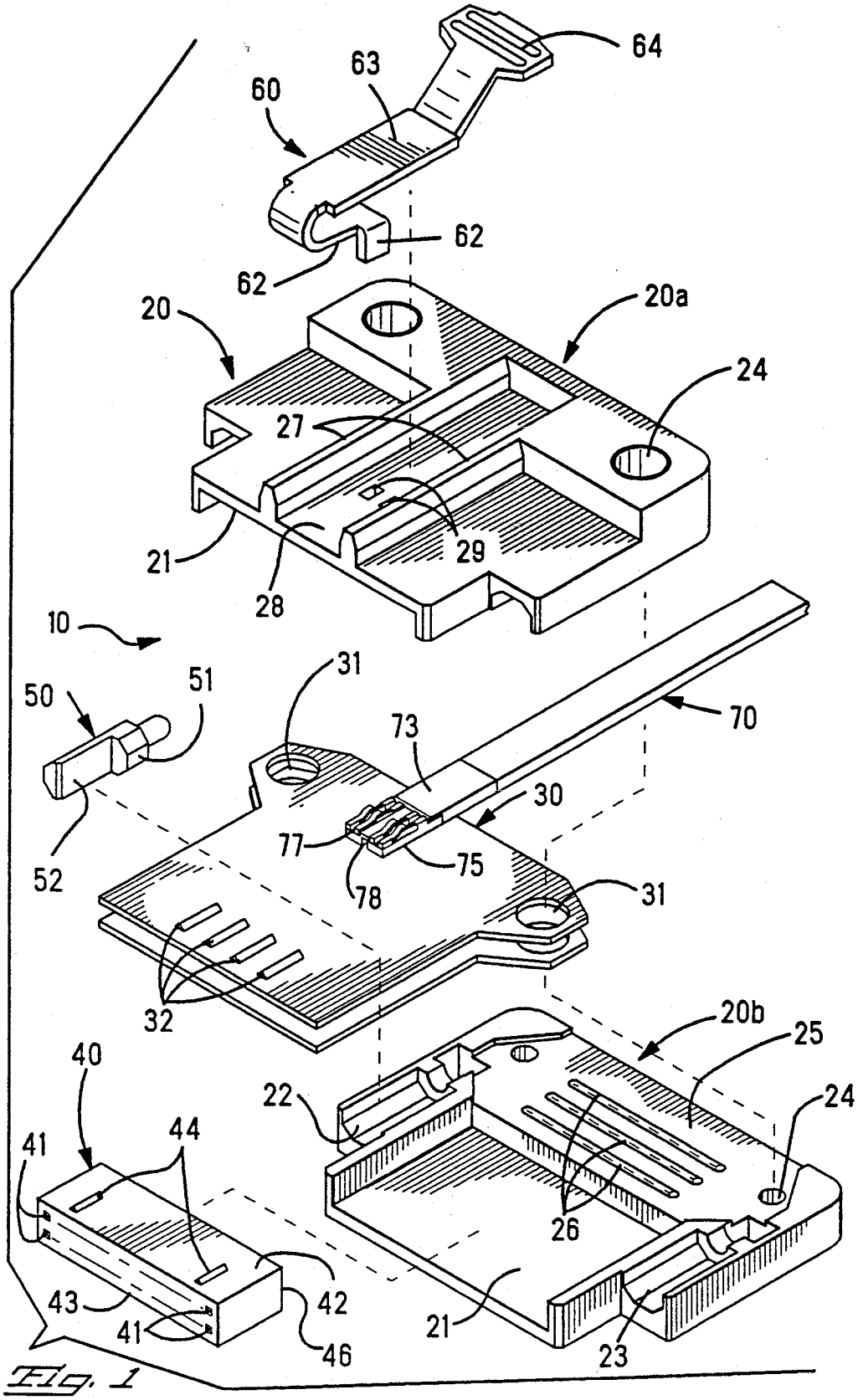
FIG. 1 is an exploded perspective view of the preferred embodiment of the shielded electrical connector according to the present invention.

Illustrated in FIG. 1 is an exploded perspective view of a preferred embodiment of the shielded electrical connector 10 according to the present invention. The shielded electrical connector 10 comprises: a two-piece die-cast, electrically conductive shell 20; an isolation metal plate 30; an insulating housing 40; a pair of right and left key members 50; a latch member 60; and a plurality of flat cables 70 (only one cable 70 is shown in FIG. 1.)

The electrically conductive shell 20 comprises an upper shell **20*a* and a lower shell 20*b*. Both shells 20*a*, 20*b* are essentially similar in shape and dimension. However, they differ in that the bottom surface of the lower shell 20*b* is generally flat while additional structures are provided on the upper surface of the upper shell for mounting a latch member 60. The electrically conductive shell 20 has a recess 21 to define a cavity at the front center portion for receiving the insulating housing 40 and the metal isolation wall 30. At both sides of the recess 21, there are keyways 22, 23 for receiving the pair of key members 50. Screw holes 24 are formed in both shells 20*a*, 20*b* near the rear end of the electrically conductive shell 20 for screw mounting both shells 20*a*, 20*b*. The electrically conductive shell 20 has a raised floor surface 25 at the rear portion of the recess 21 on the surface of which a plurality of ribs 26 are formed (3 rows in the shown preferred embodiment). As described in detail hereinafter, the ribs 26 act as a strain relief for the cable 70 of each connector module. A pair of generally parallel rails 27 are formed in the upper surface of the upper shell 20*a* from the front end toward the rear end at the center portion thereof for inserting and mounting one end of the latch member 60 in mounting holes 29 in a recess 28 between the rails 27**.

The key member 50 may be a rod-like member made from, for example, octagonal stock and is preferably made from a light metal. A cut-away portion 52 is formed at the front end of a center portion 51 so that only a selected matable connector (not shown) having the complementary key member will mate with the connector. The function of the key member 50 will be described hereinafter.

The metal isolation walls 30 are a pair of essentially identical metal plates for placing in the shells 20*a*, 20*b*. Circular holes 31 are bored near the back end of each isolation wall 30 at locations corresponding to the screw holes 24 in the shell 20 for integrating the both shells 20*a*, 20*b* by bolts. A plurality of ribs 32 are formed near the front end of each isolation wall 30.

The latch member 50 may be identical to the latch arm made by stamping and forming a resilient metal plate as is disclosed in Japanese UM laid-open no. 116674/91. That is, a pair of mounting ears 62 at both sides of the free end of a lower leg 61 of a generally V-shaped latch arm are inserted and secured in the mounting holes 29 in the upper shell 20*a*. An upper leg 63 is longer than the lower leg 61 and extends backwardly from the mating (or front) end at an angle. An operation portion 64 is formed at the free end of the upper leg 63.

A cable 70 is a flat cable known as the STAR cable and comprises, for example, a pair of signal conductors at each side of a center ground conductor and covered with an insulator. At one end of the cable 70, a plurality of contacts (e.g., receptacle or female contacts) retained in a base housing 76 are terminated and secured by a hot melt technique to constitute a connector module 75 as described hereinafter. Disposed at the front portion of the electrically conductive shell 20 is an insulating housing or a cover housing 40 to be secured over the aforementioned base housing 76 of the module 75. In the embodiment, the cover housing 40 contains two rows of contact insertion openings 41 and a recess (not shown) for receiving the base housing 76 of module 75 from the rear face toward the front face. As illustrated in FIG. 1, a plurality of ribs 44 may be formed on the upper surface 42 and the lower surface 43 of the cover housing 40 for interference fitting with engaging channels (not shown) in the inner walls of the recess 21 of the electrically conductive shell 20 for retention purposes.

The assembling steps of the shielded electrical connector 10 comprising the above elements 20 through 70 will now be described. Firstly, the latch member 60 is secured onto the upper shell 20*a* and the key members 50 are inserted into the keyways 22, 23 in the lower shell 20*b* in a selected orientation. The cover housing 40 is then positioned at the front portion of the recess 21 in the electrically conductive shell 20. A desired number of cables 70 are arranged on the lower shell 20*b* so that the connector modules 75 are accommodated in the recess of the cover housing 40. Subsequently, the two metal isolation walls 30 are disposed in back-to-back manner. Similarly, cables 70 are terminated to a plurality of connector modules 75 and are arranged on the upper isolation wall 30. Finally, both shells 20*a*, 20*b* are integrated using bolts to complete the shielded electrical connector 10.

Figure 2:
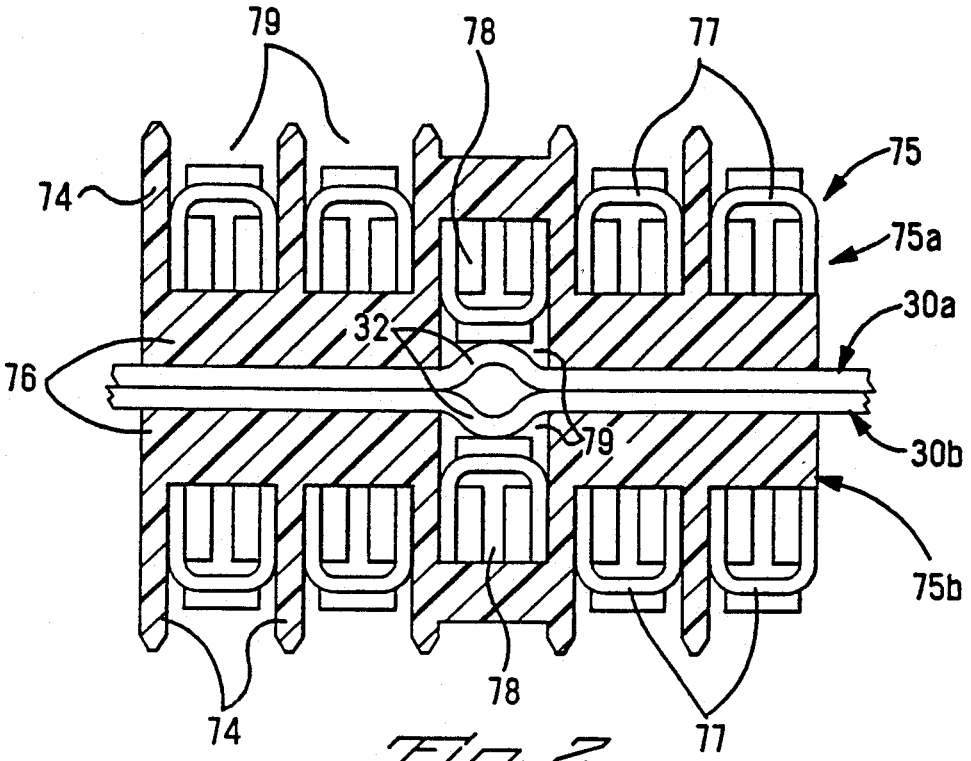
FIG. 2 is an enlarged cross-sectional view of the connector module portion shown in FIG. 1.

Illustrated in FIG. 2 is a cross sectional view of a pair of connector modules 75 terminated to the ends of the cables 70 shown in FIG. 1 and disposed on both sides of the isolation walls 30. Since the connector modules 75*a*, 75*b* disposed on the upper and lower sides of the stacked isolation walls 30*a*, 30*b* are symmetrical, only the upper connector module 75*a* will be described herein. The connector modules 75*a* comprise: the base housing 76 having a plurality of contacts terminated to one end of the cable 70 containing a total of five conductors; or two signal conductors at each side of the center ground conductor, and secured by a plastic material 73 formed by a so-called hot melt technique. Each connector module 75 is positioned in such a manner that the center or the ground conductor 78 is aligned with one of the ribs 32 on the isolation wall 30. The base housing 76 is provided with total five channels 79, one open downwardly at the position corresponding to the ground contact 78, and four open upwardly at both sides and the positions corresponding to the four signal contacts 77. There are formed isolation walls 74 between adjacent channels 79 but no isolation wall 74 is formed at the right most position or the outside of the right most signal contact 77 in FIG. 2. However, it is to be understood that an isolation wall is similarly formed for such contact 77 by the left most isolation wall of the adjacent connector module.

Figure 3:
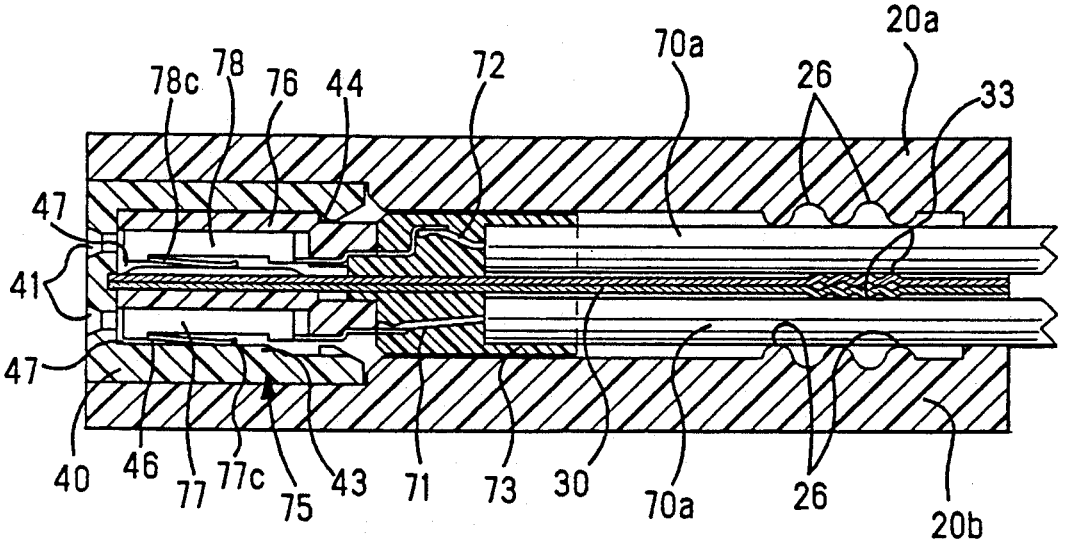
FIG. 3 is a longitudinal cross-sectional view of the shielded electrical connector of FIG. 1.

The signal and ground contacts 77, 78 are identical to each other as shown in FIG. 8. It is to be noted that the contacts 77, 78 are essentially equidistant from the isolation wall 30. However, the ground contact 78 is rotated 180° with respect to the signal contacts 77. As described in detail hereinafter, each signal contact 77 is generally Unshaped in cross-section and has a pair of resilient contact portions 77*a*, 77*b* formed by inwardly deforming both sidewalls and also a cantilever type resilient strip 77*c* is formed by cutting, raising and outwardly bending the bottom surface of the U-shaped portion. Similarly, the ground contact 78 has resilient contact portions 78*a*, 78*b* at both sides and a resilient strip 78*c* on the bottom surface. As best shown in FIG. 3, the resilient strip 78*c* of the ground contact 78 is constructed to resiliently engage the rib 32 on the isolation wall 30. That is, the channel 79 for the ground contact 78, and the rib 32 on the isolation wall 30, constitute alignment and guide portions and the shortest and most direct electrical engagement therebetween.

FIG. 3 is a cross sectional view of the cover housing and the electrically conductive shield 20 assembled as the connector modules 75*a*, 75*b* in FIG. 2, wherein the upper and lower halves 20*a*, 20*b* show the cross sectional views at the ground contact 78 and the signal contact 77 positions, respectively. Each signal conductor 71 of the cables 70*a*, 70*b* is welded to the respective signal contact 77, while each ground conductor 72 is connected to the ground contact 78. The end portion of the cable 70 including the weld junction portions is integrally molded with plastic material 73 by a hot-melt technique. As is apparent in FIG. 3, the resilient strip 78*c* of the ground contact 78 deflects and biasingly engages the rib 32 on the isolation wall 30 for a ground connection, thereby helping to support the ground contact 78 and aligning the aperture 41 with the ground contact 78 for insertion of a termination post. Also, the resilient strip 77*c* of each signal contact 77 engages insulating rib 43 in a recess 46 at the rear portion of the cover housing 40, thereby deflecting and pressing the signal contact 77 toward the isolation wall 30, thereby helping to support the signal contact 77 and aligning the aperture with the contact 77 for insert of a termination post. This maintains the gap 47 between the isolation wall 30 and each signal contact 77, thereby establishing the so-called stripline configuration for transmitting high frequency signals with a minimum of distortion. A step portion 44 followed by the tapered portion near the rear end of the recess 42 in the cover housing 40 acts to retain the base housing 76 received in the recess 46.

A wave portion 26 is formed on the inner wall of the electrically conductive shell 20 at a remote location from the cable 70, and constitutes a strain relief for the cable 70 by grabbing the jacket thereof. In the shown embodiment of FIG. 3, a wave portion 33 is also formed in the isolation wall 30 at the corresponding location to the wave portion 26 in the shell 20. Both wave portions 26 and 33 provide sufficient strain relief for the cable 70 to prevent electrical discontinuity due to overstress to the welded portions.

Figure 4:
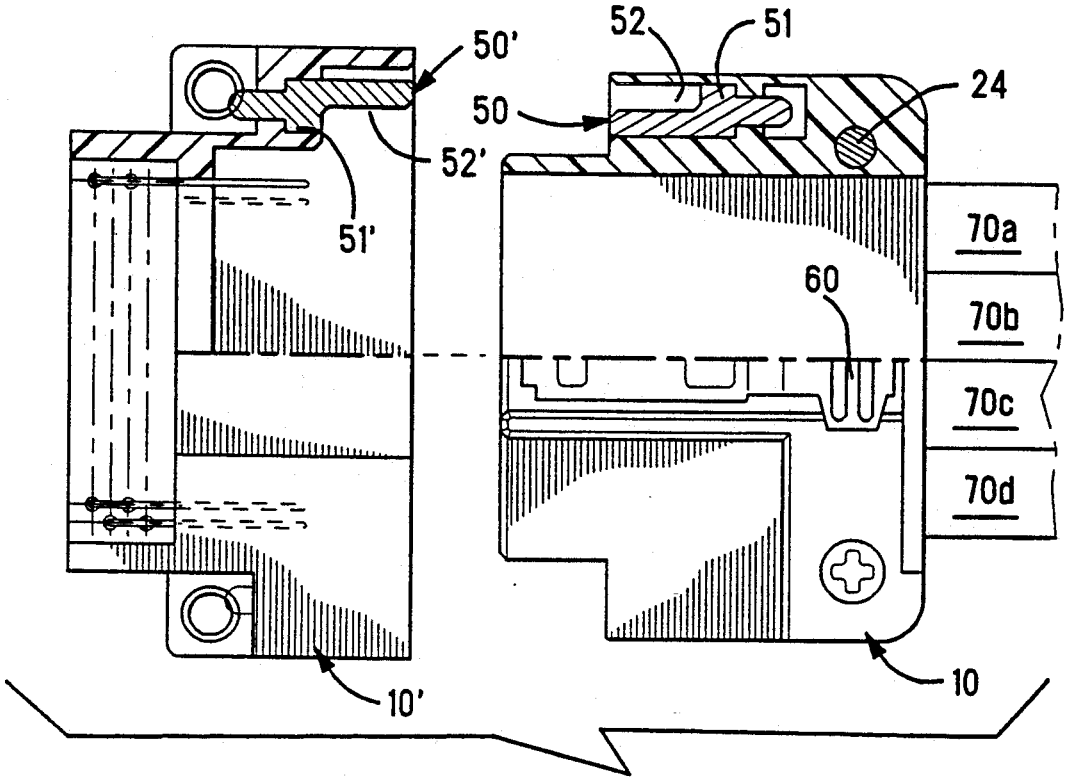
FIG. 4 is a cross-sectional view showing the unmated condition of the shielded electrical connector of FIG. 1.
Figure 5:
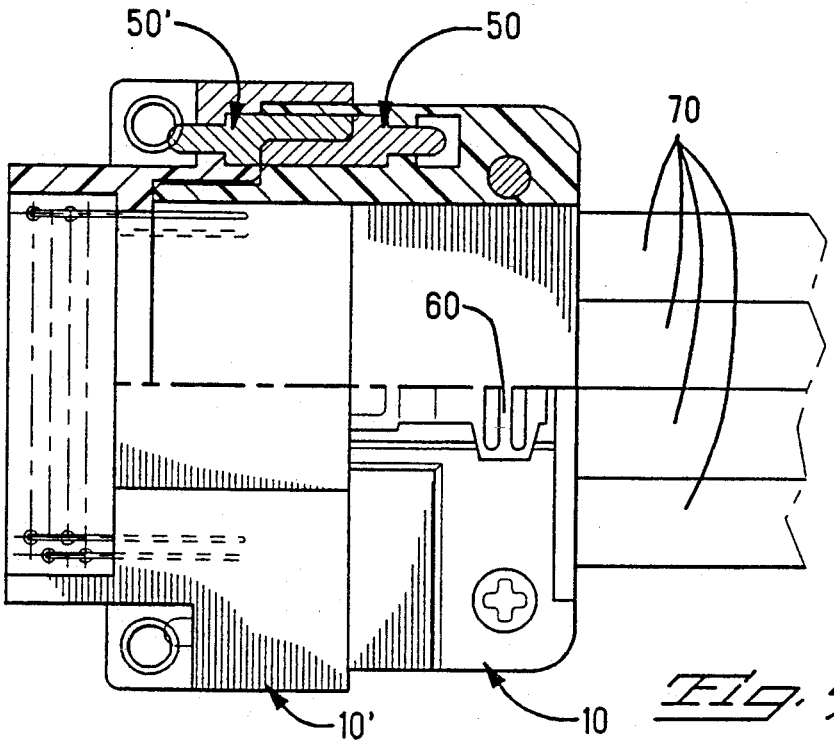
FIG. 5 is a cross-sectional view of the connector of FIG. 1 in a mated condition.

FIGS. 4–5 illustrate an example of a matable connector 10′ to be used with the shielded electrical connector 10 of the present invention. FIG. 4 shows both connectors 10, 10′ in the unmated or separated condition, while FIG. 5 is a plan view of the connectors 10, 10′ in the mated condition. As understood from FIGS. 4–5, there are a pair of programmed key members 50, 50′ at both sides of the electrically conductive shells for the both connectors 10, 10′. The cut-away portions of the key members 50, 50′ are made complementary to each other so that only particular connectors can mate to each other (see FIG. 5), thereby avoiding any danger of accidentally mating a connector having an unmatching key program.

It is to be noted that the assembled shielded electrical connector 10 can be disassembled by loosening the bolts to disintegrate the electrically conductive shell 20 for modifying the key of the key member 50 and replacement or rearrangement of the cables 70 in the connector module 75.

Figure 6:
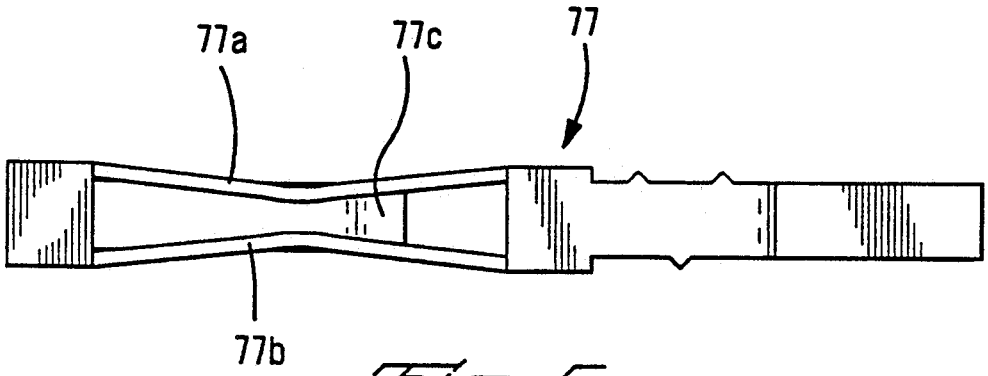
FIG. 6 is a top view of a contact used in the connector of FIG. 1.
Figure 7:
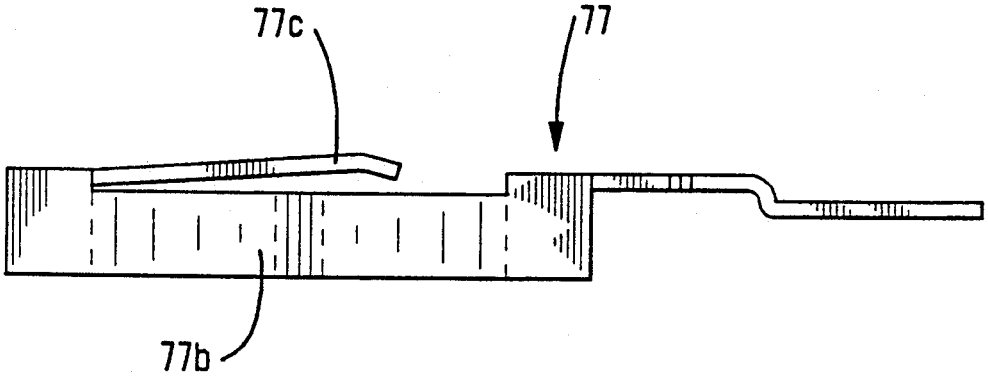
FIG. 7 is a side elevational view of the contact of FIG. 6.

FIGS. 6–7 illustrate an example of the contact 77, 78 to be used in the present invention. FIG. 6 is a plan view while FIG. 7 is a side view. As apparent from FIGS. 6–7, the contact can be made by stamping and forming a metal plate. Although both contacts 77, 78 are identical as mentioned hereinbefore, a brief description is made hereunder about the signal contact 77 for convenience.

The contact 77 comprises the forward portion and the rear portion of a generally Unshaped cross-section. The sidewalls between ends are bent toward each other to provide resilient contact portions 77*a*, 77*b*. Also, the bottom surface is cut and raised from the front to the rear portion and bent outwardly in "<" shape to form the cantilever type resilient strip 77*c*. The matable connector 10′ in FIG. 4 has, for example, rectangular post contacts for establishing electrical contact between the contact portions 77*a*, 77*b*. It is, of course, possible that the contact shape can be circular or any other shape.

The preferred embodiment of the shielded electrical connector according to the present invention has been described in detail hereinbefore by reference to the drawings. However, it is to be understood for a person having an ordinary skill in the art that the present invention is not limited to only such a preferred embodiment, and that various modifications can be made to best fit particular needs without departing from the scope and spirit of the present invention. For example, the contacts may be any other conventional design depending upon particular applications.

I claim:

1. An electrical connector comprising:

a connection module having a plurality of channels for accommodating electrical contacts;

a plurality of ground contacts and signal contacts having an insertion axis for insertion of termination posts, said ground contacts and said signal contacts being disposed in said channels of said connection module for termination with a plurality of electrical conductors;

an insulation housing having a recess which internally accommodates said module, said insulation housing having apertures each having a longitudinal axis for insertion of said termination posts;

a metallic isolation wall which abuts said insulation housing and said module, said isolation wall having a raised rib which protrudes into at least one of said channels; and wherein at least one of said contacts has a resilient biasing arm which engages said raised rib and thereby deflects.

2. The electrical connector of claim 1, wherein said at least one contact is disposed in an inverted position relative to the other contacts.

3. The electrical connector of claim 1, wherein the contacts have resilient wall portions which are deformed inwardly.

4. An electrical connector comprising:

a connection module having a plurality of channels for accommodating electrical contacts;

a plurality of electrical contacts having an insertion axis for insertion of termination posts, said contacts being disposed in said channels of said connection module for termination with a plurality of electrical conductors;

at least a pair of metallic isolation walls which abut said module, each said isolation wall having a raised rib which protrudes into at least one of said channels;

wherein at least one of said contacts has a resilient biasing arm which engages at least one of said raised ribs and thereby deflects.

5. The electrical connector of claim 4, wherein said at least one contact is disposed in an inverted position relative to the other contacts.

6. The electrical connector of claim 4, wherein the the contacts have resilient wall portions which are deformed inwardly.

7. A sheilded electrical connector comprising:

a connection module having a plurality of channels for accomodating electrical contacts;

a plurality of ground contacts and signal contacts having an insertion axis for insertion of termination posts, said ground contacts and said signal contacts being disposed in said channels of said connection module for termination with a plurality of electrical conductors;

an insulation housing having a recess which internally accomodates said module, said insulation housing having apertures each having a longitudinal axis for insertion of said termination posts;

wherein at least one of said contacts has a resilient biasing arm which resilently biases and supports said at least one contact so that said contact insertion axis and said aperture axis are aligned.

8. The electrical connector of claim 7, wherein said at least one contact is disposed in an inverted position relative to the other contacts.

9. The electrical connector of claim 7, wherein the the contacts have resilient wall portions which are deformed inwardly.

* * * * *